US008562399B2

(12) United States Patent
Lübker et al.

(10) Patent No.: US 8,562,399 B2
(45) Date of Patent: Oct. 22, 2013

(54) VENTILATION VALVE ARRANGEMENT AND TRANSPORT CONTAINER WITH A VENTILATION VALVE ARRANGEMENT

(75) Inventors: Lars Lübker, Haderslev (DK); Gert Joergensen, Aabenraa (DK)

(73) Assignee: Maersk Container Industri AS, Tinglev (DK)

( * ) Notice: Subject to any disclaimer, the term of this patent is extended or adjusted under 35 U.S.C. 154(b) by 976 days.

(21) Appl. No.: 12/472,756

(22) Filed: May 27, 2009

(65) Prior Publication Data

US 2009/0298409 A1 Dec. 3, 2009

(30) Foreign Application Priority Data

May 29, 2008 (DE) ..... 10 2008 025 817

(51) Int. Cl.

| | |
|---|---|
| ***F24F 7/00*** | (2006.01) |
| ***F24F 13/06*** | (2006.01) |
| ***F24F 13/10*** | (2006.01) |
| ***A01H 5/00*** | (2006.01) |
| ***E03B 1/00*** | (2006.01) |
| ***F16K 31/00*** | (2006.01) |
| ***F16K 39/00*** | (2006.01) |
| ***F16K 31/20*** | (2006.01) |
| ***F16K 31/44*** | (2006.01) |

(52) U.S. Cl.

USPC ..... 454/323; 137/601.02; 137/601.15; 251/253

(58) Field of Classification Search

USPC ..... 454/323, 255; 251/251, 253; 137/599.01, 601.01, 601.02, 601.15, 137/628, 630.2, 601.05, 601.07, 601.16

See application file for complete search history.

(56) References Cited

U.S. PATENT DOCUMENTS

| | | | | |
|---|---|---|---|---|
| 1,732,171 | A * | 10/1929 | Simmons | 454/295 |
| 2,232,597 | A * | 2/1941 | Downey | 137/630.2 |
| 3,128,791 | A * | 4/1964 | Haessler et al. | 137/868 |
| 3,566,916 | A * | 3/1971 | Root | 137/601.07 |
| 5,872,721 | A * | 2/1999 | Huston et al. | 702/24 |
| 6,595,847 | B1 | 7/2003 | Freese et al. | |
| 6,763,677 | B1 | 7/2004 | Burchill et al. | |
| 7,171,821 | B2 | 2/2007 | Yoong et al. | |
| 7,625,277 | B2 * | 12/2009 | Palmer | 454/255 |
| 2007/0180848 | A1 * | 8/2007 | Lazzarato et al. | 62/408 |
| 2007/0256445 | A1 * | 11/2007 | Grigoletto et al. | 62/408 |

FOREIGN PATENT DOCUMENTS

| | | | |
|---|---|---|---|
| CN | 1871480 | A | 11/2006 |
| CN | 101067509 | A | 11/2007 |
| DE | 3431331 | A1 | 3/1986 |

(Continued)

*Primary Examiner* — Craig Schneider
*Assistant Examiner* — Frederick D Soski
(74) *Attorney, Agent, or Firm* — McCormick, Paulding & Huber LLP

(57) ABSTRACT

The invention concerns a ventilation valve arrangement (1) with two valve openings (5, 6) in a valve plate (3), the opening degrees of said openings being controllable by means of a valve element, which is rotatable in relation to the valve plate (3). It is endeavored to create a large range of control opportunities in a cost-efficient manner. For this purpose it is provided that in parallel to at least one valve opening (5, 6) a ventilation channel (9) is arranged, whose flow cross-section is adjustable by means of a motor controlled valve (10). The ventilation valve arrangement (1) can be dimensioned so that at the same time it serves as underpressure valve for a transport container.

16 Claims, 3 Drawing Sheets

(56) References Cited

FOREIGN PATENT DOCUMENTS

| | | | |
|---|---|---|---|
| DE | 4447135 | A1 | 7/1995 |
| EP | 1 852 661 | A2 | 11/2007 |
| GB | 267656 | A | 3/1927 |
| GB | 285008 | A | 8/1928 |
| WO | 92/05043 | A1 | 4/1992 |

* cited by examiner

VENTILATION VALVE ARRANGEMENT AND TRANSPORT CONTAINER WITH A VENTILATION VALVE ARRANGEMENT

CROSS REFERENCE TO RELATED APPLICATION

Applicant hereby claims foreign priority benefits under U.S.C. §119 from German Patent Application No. 10 2008 025 817.2 filed on May 29, 2008, the contents of which are incorporated by reference herein.

FIELD OF THE INVENTION

The invention concerns a ventilation valve arrangement with two valve openings in a valve plate, the opening degrees of said openings being controllable by means of a valve element, which is rotatable in relation to the valve plate.

BACKGROUND OF THE INVENTION

Such a ventilation valve arrangement is, for example, known from U.S. Pat. No. 6,763,677 B1. Such a ventilation valve arrangement is often also called "butterfly valve". The two valve openings are arranged in two quadrants of a circle. In the two other quadrants of the circle, the valve plate is impermeable. The valve element has a similar embodiment, that is, it has a circular embodiment, in which openings are arranged in two quadrants. If the openings in the valve element come to overlap the valve openings, the ventilation valve arrangement is completely open. If, however, the closed quadrants of the valve element cover the valve openings, the ventilation valve arrangement is closed. Interim positions are possible. One of the valve openings is connected to the suction side of a ventilation system, and the other valve opening is connected to the pressure side, so that an air exchange with the inside of a container can take place via the two valve openings. The fresh air supplied is mixed with an air flow circulating in the container. For this purpose, the ventilation valve arrangement is built into the front wall of a transport container. The opening degree of the valve arrangement is set manually.

U.S. Pat. No. 7,171,821 B2 shows a temperature control unit with a ventilation arrangement, in which a check valve is provided, which closes an opening or releases it with different opening degrees. This check valve can be stopped in different angle positions. Sensors are provided to warn an operating staff that the ventilation valve arrangement should be adjusted. However, this is relatively elaborate.

From U.S. Pat. No. 6,595,847 B1 is known a solution for a ventilation valve arrangement, in which the check valve can be adjusted by means of a motor. The motor turns a handle, which again activates the check valve. Such a motor design is expensive, at least when it has to influence a relatively large valve opening.

SUMMARY OF THE INVENTION

The invention is based on the task of providing a large band width of control possibilities with little effort.

With a ventilation valve arrangement as mentioned in the introduction, this task is solved in that in parallel to at least one valve opening a ventilation channel is arranged, whose flow cross-section is adjustable by means of a motor controlled valve.

With this embodiment, on the one side the air exchange between the container and the environment through the valve openings can be influenced by adjusting the valve element. This can be made by an operator, who turns the valve element in relation to the valve plate, as known per se. Additionally, the air exchange can be influenced in that the ventilation channel is opened more or less by the motor controlled valve. A motor drive is required for the motor controlled valve, said motor being controllable in many different ways, for example by means of a remote control by an operator, or automatically via a control circuit comprising the corresponding sensors. Thus, with such a ventilation arrangement the choice of adjustment option for the ventilation valve arrangement is free.

It is preferred that with an open valve the ventilation channel has a larger flow resistance than the allocated valve opening with its largest opening degree. In this connection, the fact is utilised that articles or goods in the transport container, for which an automatically controlled ventilation is suitable, breath or degas less, whereas goods degassing more and accordingly requiring a larger air supply can usually do with a simple, manually adjustable ventilation. As a valve with a small valve opening requires a correspondingly less elaborate drive, the ventilation valve arrangement on a whole can be made with little effort, that is, both light-weight and cost-effective. When the automatic control shall be active, the valve element is adjusted so that the valve openings are closed. If the air exchange through the ventilation valve arrangement shall only be adjusted manually, the automatic control is controlled so that it closes the motor controlled valve and the valve element is turned in relation to the valve plate so that the opening degree of the valve openings has the desired size.

Preferably, the ventilation channel has an opening in the valve plate, which can be closed by the valve element. This is a simple way of ensuring that either a manual setting or an automatic setting of the ventilation valve arrangement is made. If the valve opening is released, the valve element is turned, so that the motor controlled valve can no longer have an influence. The opening of the ventilation channel is then namely closed, so that an unintentional activation of the valve allocated to the ventilation channel does not cause a change of the ventilation situation.

Preferably, the valve has a closing spring, and a drive acts in the opening direction upon an auxiliary valve element. Thus, the drive can be designed relatively simply. The closing spring ensures that the auxiliary valve element is prestressed in the closing direction.

It is preferred that the auxiliary valve element is arranged on a tappet and the drive comprises a cam disc interacting with the tappet. Depending on the angle position assumed by the cam disc in relation to the tappet, the auxiliary valve element is then lifted more or less from the valve seat. As the angle position of the cam disc can be set very accurately, also the opening degree of this valve can be set relatively accurately.

Preferably, the auxiliary valve element can be lifted from its valve seat by means of a pressure difference. Thus, the closing spring is dimensioned accordingly. In cooled transport containers it may happen that, for example, a short opening of a door will permit warm air to enter the inside of the transport container, which then causes an underpressure in the transport container when cooled. In order to prevent the underpressure from damaging the transport container, the auxiliary valve element can lift off from the valve seat, so that a pressure equalisation can take place. However, the auxiliary valve element can still be activated by the drive.

Preferably, the movement direction of the auxiliary valve element is parallel to the valve opening. This embodiment has two advantages. Then, the flow path for the air flowing from the outside to the inside or from the inside to the outside can be made in the same way for both control methods inside the container, that is, inside the container the air flow will be practically the same, independently of this air flow being controlled by the interaction of valve openings and valve element or by the interaction of valve seat and auxiliary valve element. Accordingly, the changes to be made inside the transport container are not worth mentioning. Further, with such an arrangement, the dimensions of the ventilation valve arrangement in a direction perpendicular to the valve openings can be kept small. Thus, the dimensions of the ventilation valve arrangement will not be excessively enlarged.

Preferably, a ventilation channel is arranged in parallel to each valve opening. Thus, both the air flow into the transport container and the air flow out of the transport container can take place through the ventilation channel. This gives favourable flow conditions. Without large problems it is always possible to let exactly the same amount of air flow into the container than the amount flowing out of the container.

Preferably, a motor controlled valve is allocated to each ventilation channel. Thus, the flow cross-section in each ventilation channel can be changed in order to cause a satisfactory air flow control.

Preferably, both valves have a common control motor. This keeps the manufacturing costs low. Only one motor is required to control both valves. Further, in this way it is relatively easy to control both valves with a predetermined dependency on one another. In the simplest case, it can be ensured that the opening degree or the flow cross-section of both ventilation channels can always be kept equal.

In a preferred embodiment, it is provided that both ventilation channels end in the same quadrant of the valve plate. They can then be covered by one "wing" of the valve element. In particular, this makes it very easy to control both valves by the same drive.

The task is solved by a transport container comprising such a ventilation valve arrangement.

BRIEF DESCRIPTION OF THE DRAWINGS

In the following, the invention is described on the basis of a preferred embodiment in connection with the drawings, showing.

DETAILED DESCRIPTION OF THE PREFERRED EMBODIMENTS

Figure 1:
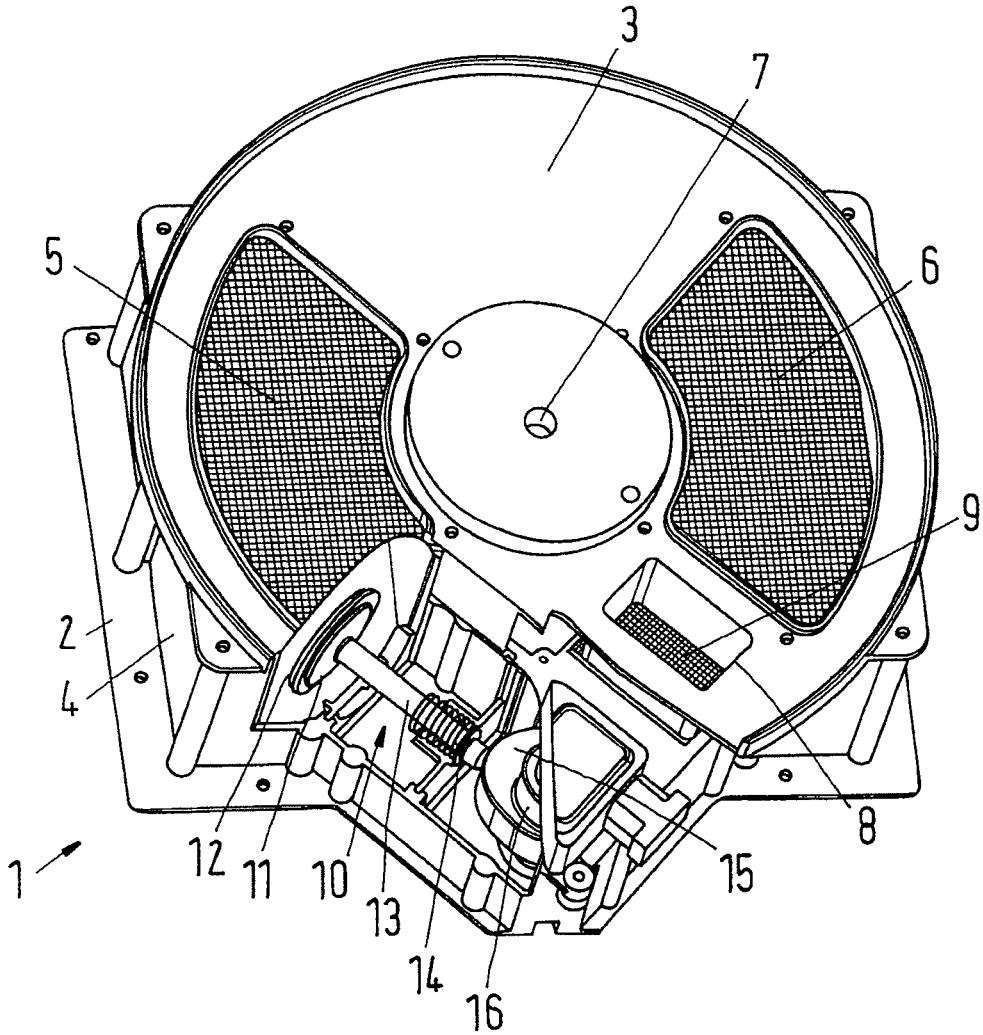
FIG. 1 is a ventilation valve arrangement in perspective view, partially in front view.

A ventilation valve arrangement 1 has a basis 2. At a distance from the basis 2 a valve plate 3 is arranged. Between the basis 2 and the valve plate 3 is a housing 4 that is divided into two chambers 17, 18 (FIG. 2) in a manner known per se.

A valve opening 5, 6 in the valve plate 3 is allocated to each chamber 17, 18. Each valve opening 5, 6 can be covered by a cover that is permeable to air, for example a fine-meshed grid or net, so that the penetration of impurities can be prevented.

The valve plate has a central opening 7, in which a valve element, not shown in detail, can be rotatably supported. The valve element has a shape, which does, apart from an exception shown below, correspond to the shape of the valve plate 3, that is, also the valve element comprises openings in two point-symmetrically arranged quadrants, whereas in the two remaining quadrants it has a closed surface. When these openings are brought to overlap the valve openings 5, 6, the ventilation valve arrangement has its largest permeability, that is, the air exchange through the ventilation valve arrangement 1 is practically unimpeded. If the valve element is rotated in relation to the valve plate 3, for example by approximately 45°, the valve openings 5, 6 will be approximately halved. Typically, however, the correlation between the opening angle and the air exchange is not linear. If the valve element is rotated so that the valve element overlaps with the massive areas of the valve plate, the valve openings 5, 6 are closed.

Additionally, the valve plate 3 comprises openings 8 (only one is shown) of ventilation channels 9. Corresponding openings are not available in the valve element. Flow-technically, the ventilation channel 9 is arranged in parallel with the valve opening 6. A corresponding ventilation channel 9 is provided for the valve opening 5.

A small valve 10 is allocated to each ventilation channel 9, the flow cross-section through the ventilation channel 9 being adjustable by means of said valve 10. The valve 10 has an auxiliary valve element 11, which interacts with a valve seat 12. The auxiliary valve element 11 is arranged at a tappet 13. The tappet 13 is loaded by a closing spring 14. In the side that is not visible from FIG. 1, the auxiliary valve element 11 bears on the valve seat 12 under the influence of the closing spring 14. In order to open the valve 10, the tappet 13 is activated by a cam disc 15 against the force of the closing spring 14. The cam disc 15 is driven by an electric motor 16.

The angle position of the cam disc 15 determines the opening degree of the valve 10. The angle position can be adjusted relatively accurately via the motor 16, which is, for example, made as a step-motor.

The closing spring 14 is dimensioned so that under normal circumstances it holds the auxiliary valve element 11 at the valve seat 12 with sufficient closing force. If, however, an underpressure should occur in the transport container, for example because hot air is cooled and contracts, the underpressure causes the auxiliary valve element 11 to be lifted from the valve seat 12 until a pressure equalisation has taken place.

Figure 2:
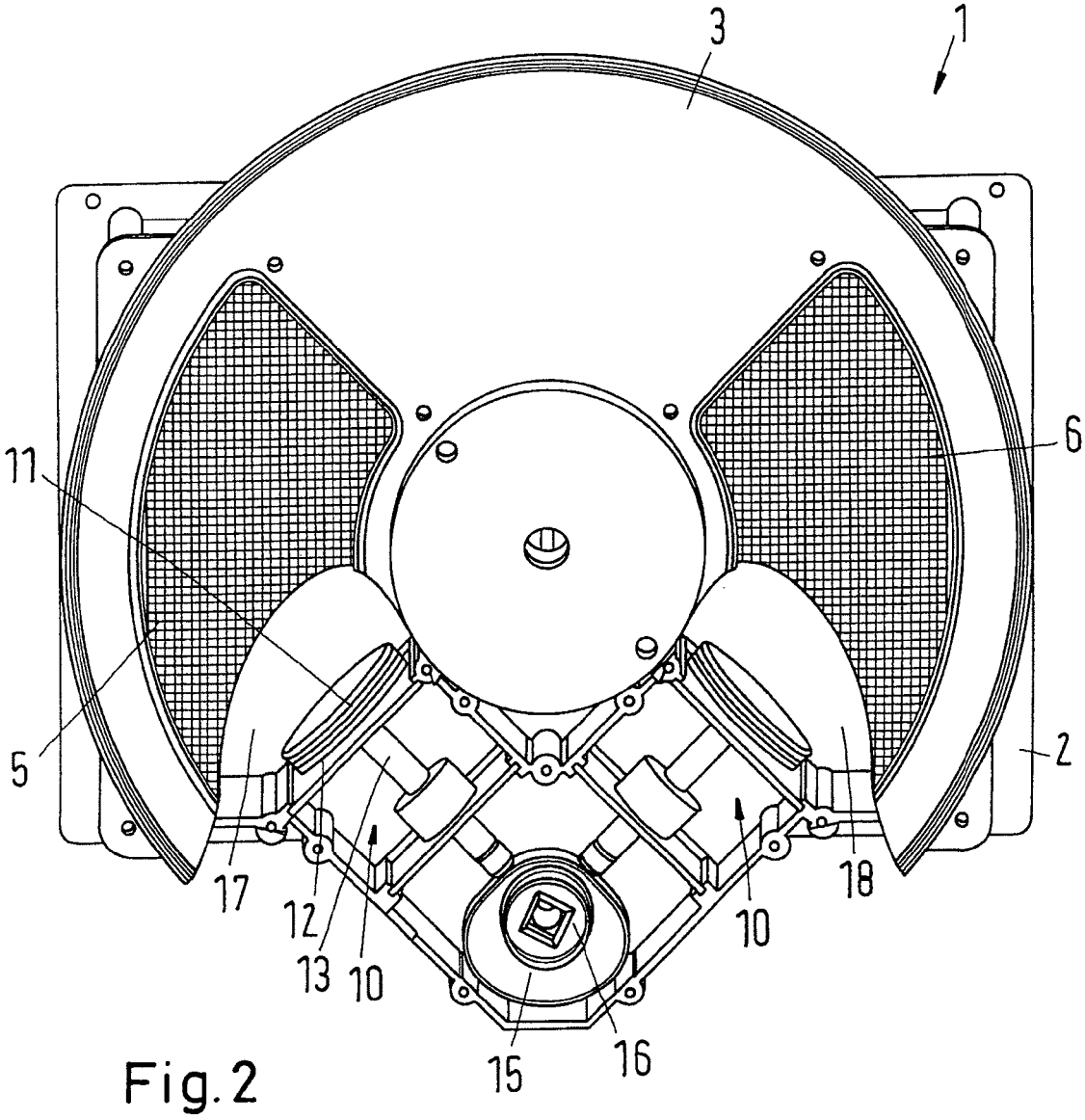
FIG. 2 is a top view of the ventilation valve arrangement with closed valves, partially in front view.

FIG. 2 shows the ventilation valve arrangement 1 with closed valves 10, and the same elements as in FIG. 1 have the same reference numbers. Here, also the two chambers 17, 18 in the housing 4 can be seen.

Both valves 10 are driven by the same motor 16 and also via the same cam disc 15. It is also possible to used different cam discs for both valves, said cam discs, however, being unrotatably connected to each other and driven by the same motor 16. This is a simple way of providing an allocation between the opening degrees of the two valves 10. In this connection, the two valves 10 can have different opening degrees. Both valves 10 are made in the same way.

Figure 3:
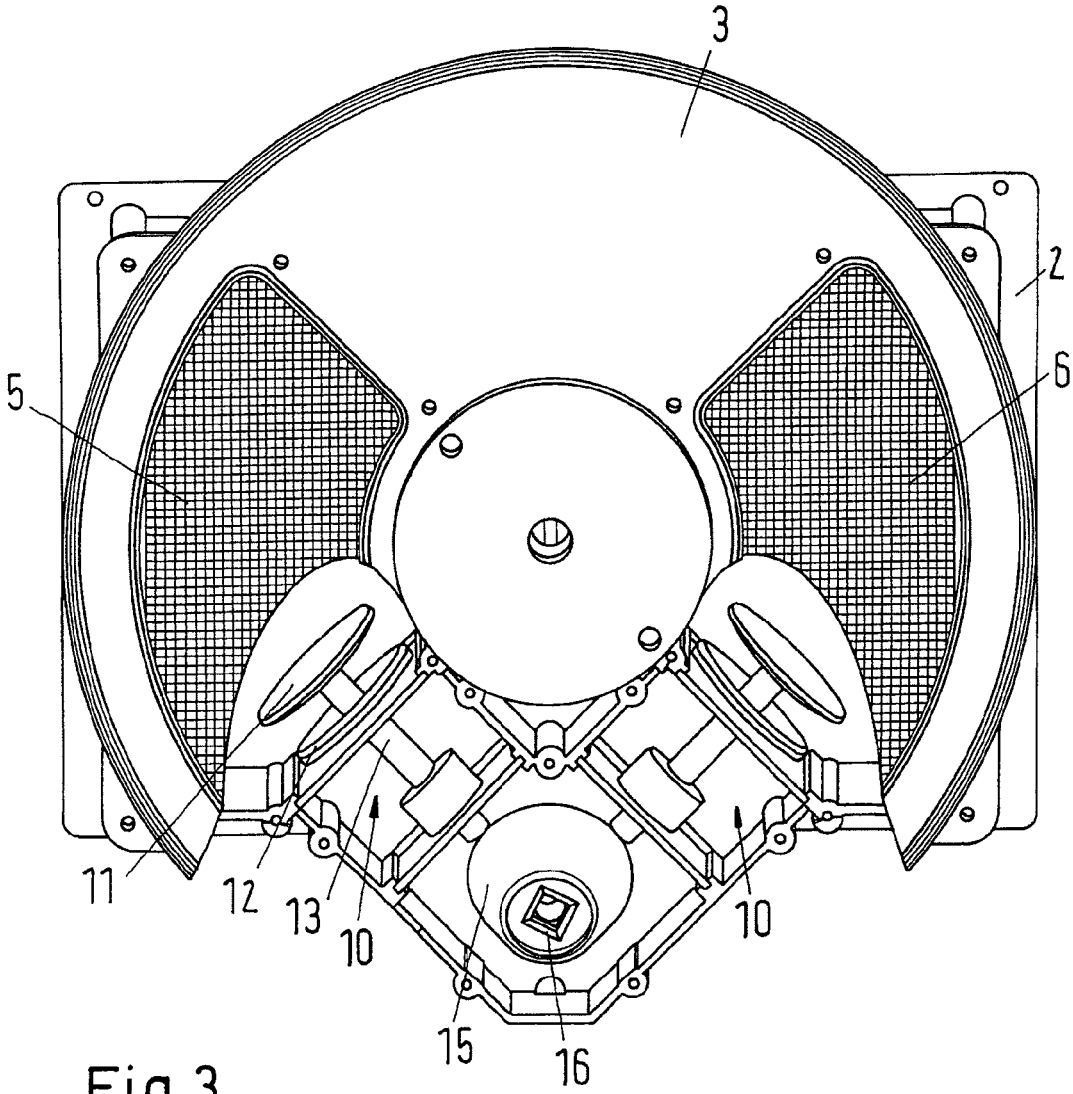
FIG. 3 shows the view according to FIG. 2 with opened valves.

FIG. 3 shows the ventilation valve arrangement 1 with open valves 10, that is, the auxiliary valve elements 11 are lifted off from the corresponding valve seats 12. For this purpose, the cam disc 15 has been turned by approximately 180°.

Instead of controlling the opening degree of the valves 10 accurately, it may be provided that the valves 10 are always completely opened or completely closed. The air exchange is then controlled in that the ratio is changed, that is the relation between the time, during which the valves 10 are open and the duration of a period from opening the valve 10 to the following opening of the valve 10, when the valve 10 has been closed in the meantime.

The major part of the ventilation valve arrangement 1 can be made of a plastic material, which makes it light and at the same time corrosion resistant. Expediently, however, the motor 16 will comprise a certain share of metal. Also the cam disc 15 and the tappet 13 can alternatively be made of metal. However, they do not increase the mass of the ventilation valve arrangement significantly.

The tappet 13 of each valve 10 is movable in parallel to the valve plate 3. Thus, the tappet 13 can have a relatively large length, also a relatively large activation length, without having to increase the dimensions of the ventilation valve arrangement 1.

The two ends 8 of the ventilation channels 9 are arranged in the same quadrant of the valve plate 3. Thus, they can always be closed at the same time, if this is desired. For the correct functioning of the ventilation valve arrangement 1, however, it is not required that the ventilation channels 9 are closed tightly by the valve element.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A ventilation valve arrangement with two valve openings in a valve plate, the opening degrees of said openings being controllable by means of a valve element, which is rotatable in relation to the valve plate, wherein in parallel to at least one valve opening a ventilation channel is arranged, the ventilation channel including a third opening in the valve plate and having a flow cross-section that is adjustable by means of a motor controlled valve; wherein the valve has a closing spring, and a drive acts in the opening direction upon an auxiliary valve element; and wherein the movement direction of the auxiliary valve element is parallel to the valve opening.

2. The ventilation valve arrangement according to claim 1, wherein with an open valve the ventilation channel has a larger flow resistance than the allocated valve opening with its largest opening degree.

3. The ventilation valve arrangement according to claim 1, wherein the ventilation channel has an opening in the valve plate, which can be closed by the valve element.

4. The ventilation valve arrangement according to claim 1, wherein the auxiliary valve element is arranged on a tappet and the drive comprises a cam disc interacting with the tappet.

5. The ventilation valve arrangement according to claim 1, wherein the auxiliary valve element can be lifted from its valve seat by means of a pressure difference.

6. The ventilation valve arrangement according to claim 1, wherein a ventilation channel is arranged in parallel to each valve opening.

7. The ventilation valve arrangement according to claim 6, wherein a motor controlled valve is allocated to each ventilation channel.

8. The ventilation valve arrangement according to claim 7, wherein both valves have a common control motor.

9. The ventilation valve arrangement according to claim 1, wherein both ventilation channels end in the same quadrant of the valve plate.

10. The ventilation valve arrangement according to claim 1, wherein the ventilation valve arrangement is on a transport container.

11. A ventilation valve arrangement comprising:

a valve plate having two valve openings and at least one ventilation opening;

a valve element that is rotatable in relation to the valve plate, the valve element controlling the opening degrees of the valve openings of the valve plate;

at least one ventilation channel arranged in parallel with one of the valve openings, the ventilation channel including the ventilation opening in the valve plate;

a motor controlled valve adapted to adjust a flow cross-section of the at least one ventilation channel;

wherein the valve has a closing spring, and a drive acts in the opening direction upon an auxiliary valve element; and wherein the movement direction of the auxiliary valve element is parallel to the valve opening.

12. The ventilation valve arrangement according to claim 11, wherein the auxiliary valve element is arranged on a tappet and the drive comprises a cam disc interacting with the tappet.

13. The ventilation valve arrangement according to claim 11, wherein the auxiliary valve element can be lifted from its valve seat by means of a pressure difference.

14. The ventilation valve arrangement according to claim 11, wherein a ventilation channel is arranged in parallel to each valve opening.

15. The ventilation valve arrangement according to claim 14, wherein a motor controlled valve is allocated to each ventilation channel.

16. The ventilation valve arrangement according to claim 15, wherein both valves have a common control motor.

* * * * *